US005588377A

United States Patent [19]

Fahmian

[11] Patent Number: 5,588,377

[45] Date of Patent: Dec. 31, 1996

[54] CONVERTIBLE TABLE CONFIGURABLE BETWEEN EXPANDED AND COMPRESSED POSITIONS

[75] Inventor: Hal Fahmian, Riverside, Calif.

[73] Assignee: Fleetwood Enterprises, Inc., Riverside, Calif.

[21] Appl. No.: 428,030

[22] Filed: Apr. 25, 1995

[51] Int. Cl.[6] ..... A47B 9/00

[52] U.S. Cl. ..... 108/145; 108/77; 108/147; 248/631; 248/164

[58] Field of Search ..... 108/77, 69, 144, 108/145, 147; 248/631, 164, 432, 439, 188.2; 312/312, 306; 254/122

[56] References Cited

U.S. PATENT DOCUMENTS

| | | | |
|---|---|---|---|
| 2,447,480 | 8/1948 | Stubbs | 108/77 |
| 3,110,476 | 11/1963 | Farris | 108/147 |
| 3,245,366 | 4/1966 | Fox | 108/145 |
| 4,221,280 | 9/1980 | Richards | 254/122 |
| 5,002,293 | 3/1991 | Gottselig | 108/145 |
| 5,131,501 | 7/1992 | Yoshikawa | 254/122 |

FOREIGN PATENT DOCUMENTS

| | | | |
|---|---|---|---|
| 3037375 | 5/1982 | Germany | 108/145 |
| 688572 | 5/1953 | United Kingdom | 108/145 |
| 1509192 | 5/1978 | United Kingdom | 108/96 |

*Primary Examiner*—Peter M. Cuomo
*Assistant Examiner*—Janet M. Wilkens
*Attorney, Agent, or Firm*—Price, Gess & Ubell

[57] ABSTRACT

A convertible table can be conveniently configured into either a coffee table or a dining table. The convertible table includes a table bottom unit supported by four legs and a table hinge secured to the table bottom unit via four lower hinge brackets. A table top unit is secured to the table hinge via four upper hinge brackets. The hinge moves between an expanded configuration and a compressed configuration to vertically move the table top unit away from the table bottom unit and back into contact with the table bottom unit, respectively.

19 Claims, 3 Drawing Sheets

CONVERTIBLE TABLE CONFIGURABLE BETWEEN EXPANDED AND COMPRESSED POSITIONS

BACKGROUND OF THE INVENTION

1. Field of the Invention

The present invention relates generally to tables and, more particularly, to tables which can be configured to take on different shapes.

2. Description of Related Art

Tables are used for various functions in our society. In the home, for example, coffee tables with low profiles are often placed in front of sofas for decorative and entertainment purposes. These coffee tables are often long, narrow, and do not stand high above the floor. Dining tables, on the other hand, often have square top surfaces which are significantly higher above the floor.

Coffee tables and dining tables of various materials, shapes, and qualities arc common. A homeowner thus can select from a large variety of coffee tables and dining tables to furnish the home.

Since many homes have limited space, the use of both a coffee table and a dining table is often not practical. For example, most mobile homes do not have sufficient space to accommodate both a coffee table and a dining table. Even if such space were available, it is often desirable to conserve space in these limited living quarters.

While the problem of limited space has no doubt been recognized in the prior art, providing a table which can be efficiently and elegantly configured in either a coffee table or a dining table has not been achieved. Accordingly, people are forced to either purchase both a coffee table and a dining table and live in cramped quarters, or to do without one of these two tables. A problem has thus existed in the art for a single table which can be configurable between a low profile coffee table configuration and a taller dining table configuration.

SUMMARY OF THE INVENTION

The present invention provides a convertible table which can be conveniently configured into either a coffee table or a dining table. The convertible table includes a table bottom unit supported by four legs and a table hinge secured to the table bottom unit via four lower hinge brackets. A table top unit is secured to the table hinge via four upper hinge brackets. The hinge moves between an expanded configuration and a compressed configuration to vertically move the table top unit away from the table bottom unit and back into contact with the table bottom unit, respectively.

The table hinge of the present invention includes an upper-front elongated member, a lower-rear elongated member, and a number of parallel fingers positioned between the two elongated members. The parallel fingers are perpendicular to the elongated members, and the elongated members fit within the hinge brackets. Another set of elongated members and parallel fingers is similarly secured into the hinge brackets. A pin runs through all of the parallel fingers to allow the parallel fingers to pivot about the pin. When all of the parallel fingers are pivoted in the vertical direction, the table top unit rises vertically, and when the parallel fingers are pivoted in the horizontal direction, the table top unit moves downward. Thus, a coffee table is formed when the parallel fingers are approximately horizontal to the floor, and a dining table is formed with the parallel fingers in a somewhat vertical orientation.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the drawing description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically.

Figures 1, 2:
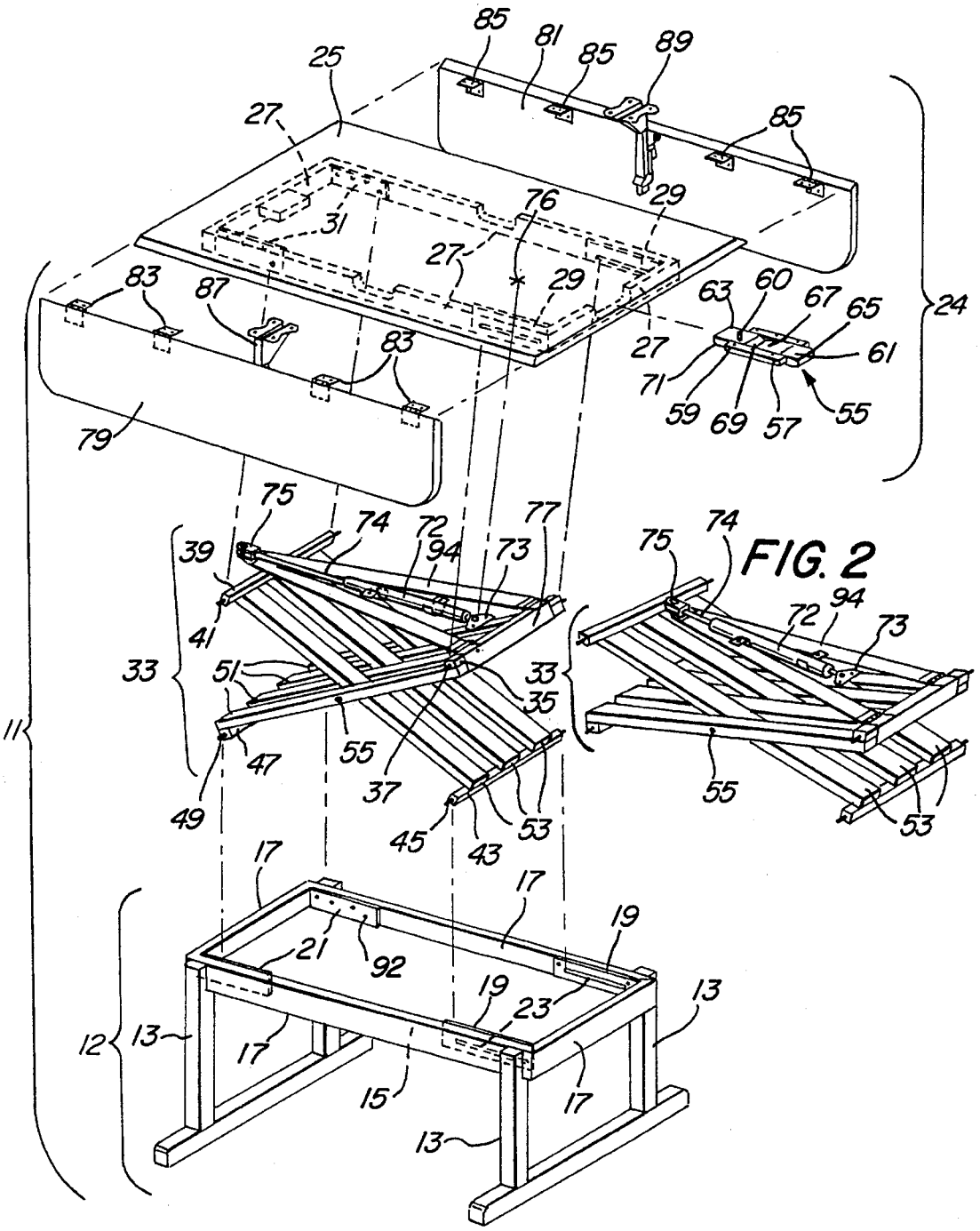
FIG. 1 is an exploded view of the convertible table of the presently preferred embodiment.
FIG. 2 is a perspective view of the table hinge of the presently preferred embodiment in a somewhat compressed configuration.

Turning to FIG. 1, the convertible table 11 of the presently preferred embodiment is shown partially disassembled. The convertible table 11 generally comprises a table bottom unit 12, a table hinge 33, and a table top unit 24. The table hinge 33 moves the table top unit 24 in a vertical direction to raise and lower the table top unit 24. FIG. 1 shows the table hinge 33 in an expanded configuration, and FIG. 2 shows the table hinge 33 in a somewhat compressed configuration.

When the table hinge 33 is in the expanded configuration, the table top unit 24 is supported well above the table bottom unit 12, and the first table leaf 79 and second table leaf 81 can be raised to increase the size of the top planar surface 25. In this configuration, the convertible table 11 serves as a dining table.

When the table hinge 33 is somewhat compressed as shown in FIG. 2, the table top unit 24 is moved closer to the table bottom unit 12. In the coffee table configuration, the table hinge 33 is fully compressed and the top side walls 27 of the table top unit 24 come into contact with the bottom side walls 17 of the table bottom unit 12. The first table leaf 79 and second table leaf 81 can be lowered to form the coffee table.

Looking further at the table bottom unit 12, the four bottom side walls 17 comprise red oak in the presently preferred embodiment and are glued to one another. The table legs 13 similarly comprise red oak and are glued to the structure formed by the four bottom side walls 17. The bottom planar surface 15 comprises red oak as well. In the presently preferred embodiment, most parts of the convertible table comprise red oak. Other types of wood, plastic, and metal may be used, according to preference.

Two lower-front hinge brackets 19 and two lower-rear hinge brackets 21 are secured to the structure formed by the four bottom side walls 17. These lower-front and lower-rear hinge brackets 19 and 21 comprise nylon in the presently preferred embodiment, and are secured using wood screws. Other securing means, of course, may be used. The lower-front hinge brackets 19 comprise slots 23, but the lower-rear hinge brackets 21 comprise only apertures 92.

The table hinge 33 comprises an upper-front elongated member 35 having two upper-front dowels 37 at opposing ends thereof, and also a lower-front elongated member 43 having two lower-front dowels 45 at opposing ends thereof. The table hinge 33 further comprises an upper-rear elongated member 39 having upper-rear dowels 41, and a lower-rear elongated member 47 having lower-rear dowels 49. The lower-rear dowels 49 fit into the apertures 24 of the lower-rear hinge brackets 21. These lower-rear dowels 49 are able to rotate within the apertures 92.

The lower-front dowels 45 fit into the slots 23 of the lower-front hinge brackets 19. These lower-front dowels 45 are adapted to slide horizontally within the slots 23. In the presently preferred embodiment, all of the dowels of the table hinge 33 comprise steel.

A first set of parallel fingers 51 is secured to the upper-front elongated member 35 and the lower-rear elongated member 47. In the presently prelimited embodiment, the first set of parallel fingers 51 comprises four red oak members, which are glued to both the upper-front elongated member 35 and the lower-rear elongated member 47. Similarly, a second set of parallel fingers 53 comprising three red oak members is glued to both the upper-rear elongated member 39 and the lower-front elongated member 43.

A pin 55 runs through all of the parallel fingers. All of the parallel fingers rotate about the pin 55. For example, FIG. 1 shows the first set of parallel fingers 51 rotated counterclockwise about the pin 55, and the second set of parallel fingers 53 rotated clockwise about the pin 55. In this configuration, the upper-front elongated member 35 is spaced apart from the lower-front elongated 43 and, similarly, the upper-rear elongated 39 is spaced apart front the lower-rear elongated member 47. This configuration thus supports the table top unit 24 high above the table bottom unit 12.

In FIG. 2, the first set of parallel fingers 51 has been rotated clockwise about the pin 55, and the second set of parallel fingers 53 has been rotated counterclockwise about the pin 55. Thus, the upper-front and lower-front elongated members 35 and 43 are moved close together, and the upper-rear and lower-rear elongated member 39 and 47 are moved close together. In this configuration, the table top unit 24 is moved close to the table bottom unit 12. In the presently preferred embodiment, all of the parallel fingers lie in a single plane when the table hinge 33 is completely compressed. In this configuration, the convertible table of the present invention takes on the form of a coffee table.

The table hinge 33 further comprises a strut 72, a front strut bracket 77, and a rear strut bracket 75. Straps 94 secure the strut 72 to the bottom of the top planar surface 25. This combination of elements serves to apply an upward force to assist in raising the table bottom unit 24 above the table bottom unit 12 in order to achieve the dining table configuration. When the table top unit 24 is raised above the table bottom unit 12, the strut 72 expands. When the table top unit 24 is pressed down onto the table bottom unit 12, the strut 72 is compressed.

In the presently preferred embodiment, the stationary end 73 of the strut 72 is secured to point 76 on the bottom of the top planar surface 25 of the table top unit 24. The sliding end 74 of the strut 72, however, moves horizontally with movement of the front strut bracket 77 and rear strut bracket 75. Thus, when the table top unit 24 is raised above the table bottom unit 12, the upper-front elongated member 35 moves closer to the upper-rear elongated member 39. The stationary end 73, however, is fixed so that the upper-front elongated member 35 actually moves closer to this stationary end 73. When the upper-front elongated member 35 moves closer to the stationary end 73, the rear strut bracket 75 pushes the sliding end 74 in the same direction (to the left) to move the sliding end 74 away from the stationary end 73. Thus, the strut 72 expands.

As shown in FIG. 2, when the table hinge 33 is compressed, the upper-front elongated member 35 moves away from the stationary end 73, and the sliding end 74 moves in the same direction to compress the strut 72. The effect of the strut 72 is to buffer the gravitational pull on the table top unit 24 when the table top unit 24 is lowered, as well as to buffer the gravitational effect when the table top unit 24 is raised above the table bottom unit 12.

The table top unit 24 comprises four top side walls 27 glued together in the presently preferred embodiment. These four top side walls 27 serve to accommodate the upper-front hinge brackets 29 and the upper-rear hinge brackets 31. Similarly to the hinge brackets in the table bottom unit 12, the upper-front hinge brackets 29 comprise slots and the upper-rear hinge brackets 31 comprise apertures 24. The first table leaf 79 and the second table leaf 81 fold out in the dining table configuration. The first table leaf 79 folds about the first butt hinges 83, and the second table leaf 81 folds about the second butt hinges 85. The first drop leaf support 87 holds the first table leaf 79 in a position parallel to the top planar surface 25, and the second drop leaf support 89 holds the second table leaf 81 in a similar parallel position.

The latch 55 is secured to the bottom of the top planar surface 25 of the table top unit 24. The latch 55 may be secured by mounting rails screwed and/or glued to the bottom of the top planar surface 25. This latch 55 comprises a first pivoting member 61 and a second pivoting member 63. The first pivoting member 61 pivots about an outer pin 57, and the second pivoting member 63 pivots about an inner pin 59. A spring 60 biases the second pivoting member 63 to contact the front strut bracket 77.

Figure 3:
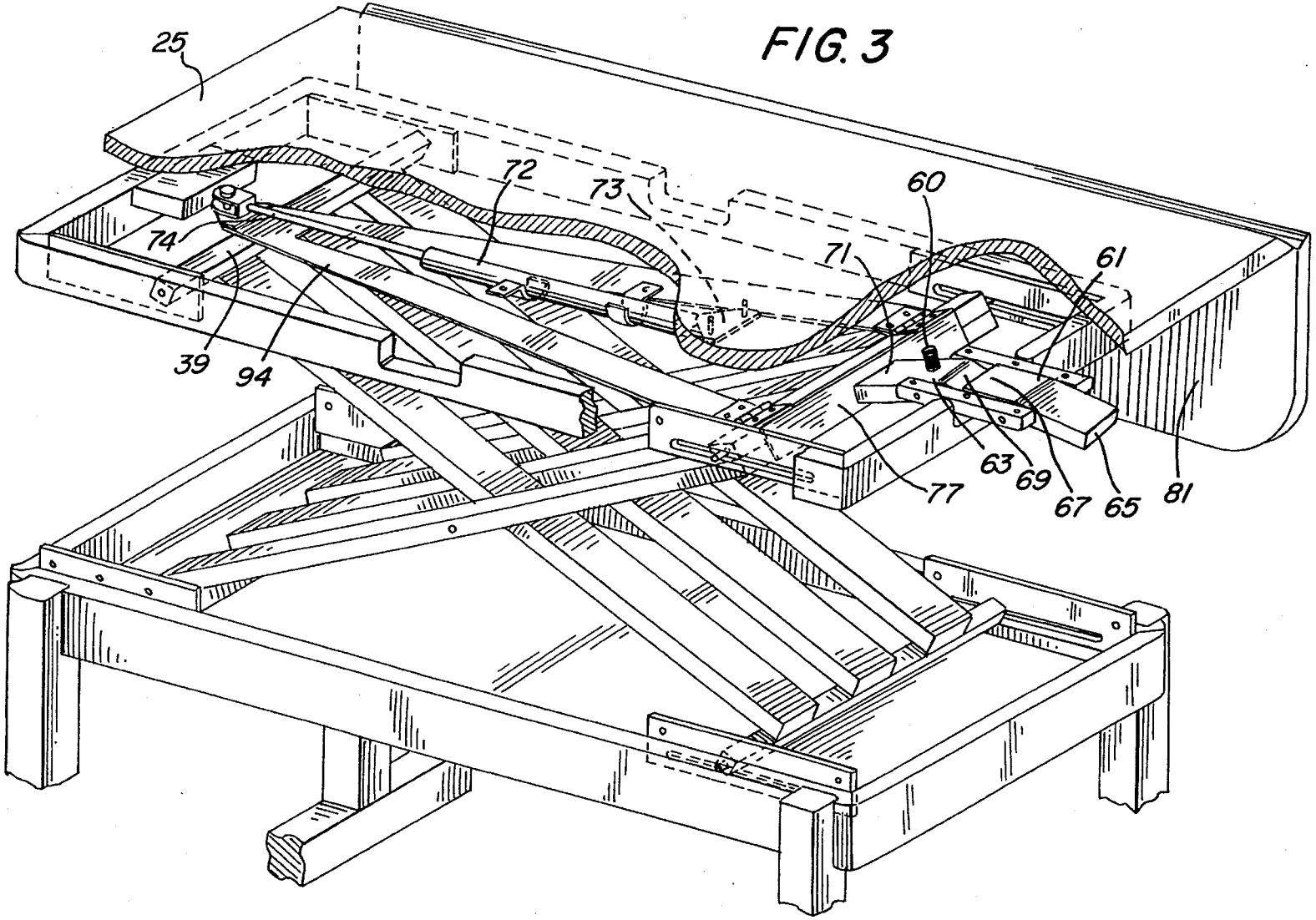
FIG. 3 is a perspective view of the convertible table.
Figure 4:
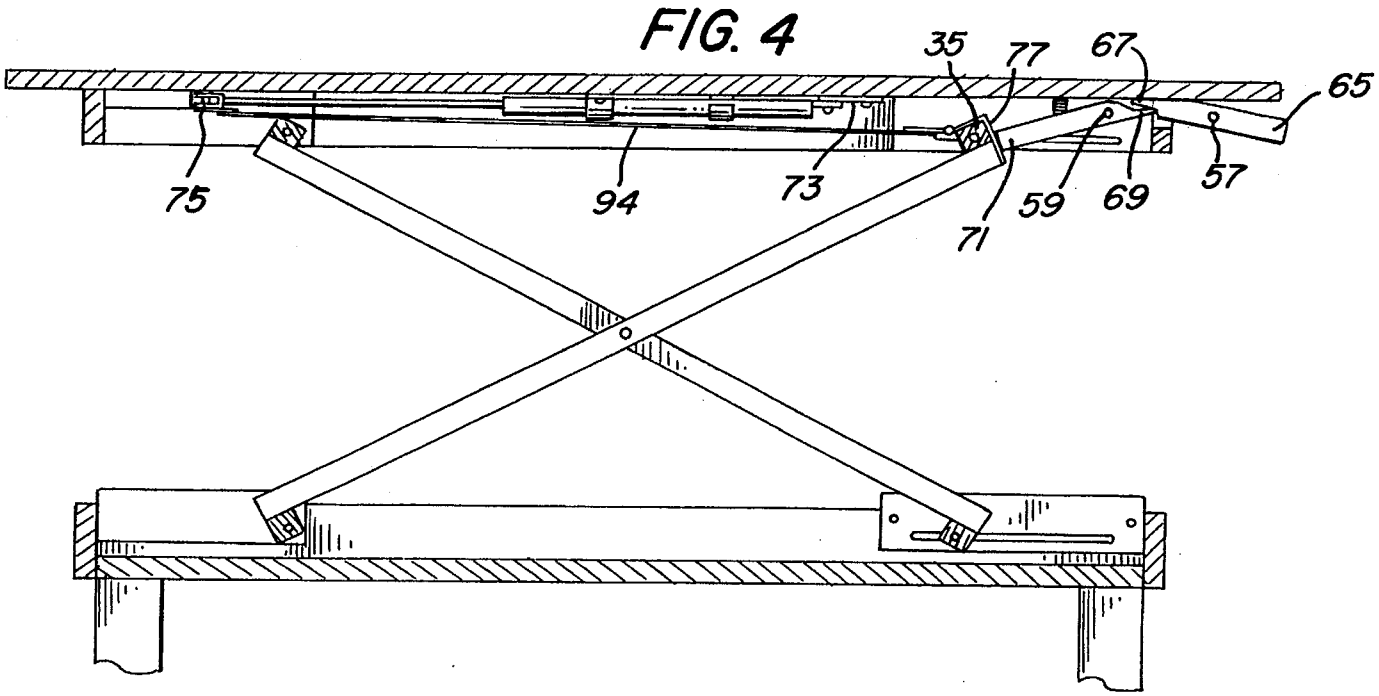
FIG. 4 is a cross-sectional view of the convertible table in the dining table configuration where the table hinge is in the expanded configuration.

As shown in FIG. 3, the spring 60 presses against the bottom the top planar surface 25 and applies force to the second pivoting member 63. The first pivoting member 61 comprises a first opposing end 65 and a second opposing end 67. Similarly, the second pivoting member 63 comprises a first opposing end 71 and a second opposing end 69. When the table top unit 24 is moved upward into the dining table configuration, the front bracket 77 moves toward the stationary end 73 of the strut 72 until the first opposing end 71 of the second pivoting member 63 is pushed by the spring 60 down onto the front strut bracket 77. In this position, the latch 55 prevents the front strut bracket 77 of the table hinge 33 from moving away in a direction away from the stationary end 73. Thus, the table hinge 33 cannot be compressed. FIG. 4 shows a cross-sectional view of this configuration.

Figure 5:
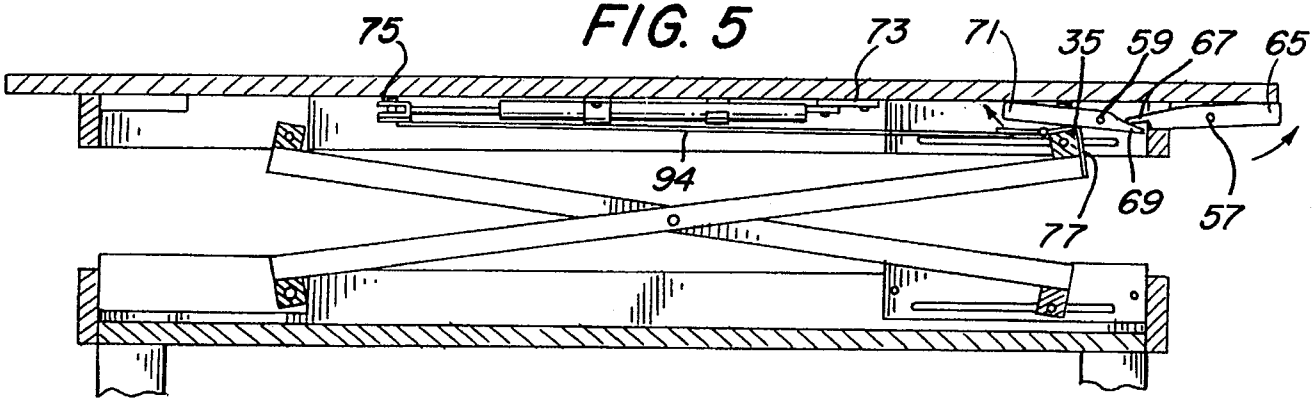
FIG. 5 is a cross-sectional view of the convertible table in the coffee table configuration where the table hinge is in a somewhat compressed configuration.

When a user applies an upward force to the first opposing end 65 of the first pivoting member 61, as shown in FIG. 5, the first opposing end 65 moves up, causing the second opposing end 67 to move down. The second opposing end 67 of the first pivoting member 61 thus pushes the second opposing end 69 of the second pivoting member 63 down, and causes the first opposing end 71 to move up. When the first opposing end 71 of the second pivoting member 63 moves up, the front strut bracket 77 is no longer blocked from moving away from the stationary end 73 of the strut 72. Thus, the table hinge 33 can assume the collapsed configuration.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A convertible table, comprising:

(a) four legs supporting the convertible table above a supporting surface;

(b) a table bottom unit, comprising:

(1) a bottom planar surface parallel to the supporting surface, the bottom planar surface having a rectangular parameter; and (2) four bottom sidewalls surrounding the rectangular parameter, each of the bottom sidewalls extending above and perpendicular to the bottom planar surface, the four bottom sidewalls forming four corners, the table bottom unit being connected to the four legs near the four corners;

(c) four bottom hinge brackets connected to the table bottom unit near the four corners;

(d) a table top unit comprising:

(1) a top planar surface parallel to the supporting surface; and (2) four top sidewalls surrounding approximately the same rectangular parameter as the four bottom sidewalls, the four top sidewalls forming four corners, each of the top sidewalls extending below and perpendicular to the top planar surface;

(e) four top hinge brackets connected to the table top unit near the four corners formed by the four top sidewalls; and (f) a table hinge positioned between the table bottom unit and the table top unit, comprising:

(1) an upper-front elongated member having two upper-front dowels at opposing ends, the two upper-front dowels fitting into a corresponding two of the four top hinge brackets;

(2) an upper-rear elongated member having two upper-rear dowels at opposing ends, the two upper-rear dowels fitting into a corresponding two of the four top hinge brackets;

(3) a lower-front elongated member having two lower-front dowels at opposing ends, the two lower-front dowels fitting into a corresponding two of the four bottom hinge brackets;

(4) a lower-rear elongated member having two lower-rear dowels at opposing ends, the two lower-rear dowels fitting into a corresponding two of the four bottom hinge brackets;

(5) a first set of parallel fingers connected between the upper-front elongated member and the lower-rear elongated member, the upper-front elongated member and the lower-rear elongated member being parallel to one another and perpendicular to the first set of parallel fingers;

(6) a second set of parallel fingers connected between the lower-front elongated member and the upper-rear elongated member, the lower-front elongated member and the upper-rear elongated member being parallel to one another and perpendicular to the second set of parallel fingers; and (7) a pin running through a center area of each of the fingers of the first and second sets of parallel fingers, the fingers rotating about the pin to bring the upper-front and lower-front elongated members into contact with one another and, at the same time, to bring the upper-rear and lower-rear elongated members into contact with one another to thereby bring the table hinge into a compressed configuration.

2. The convertible table of claim 1, wherein the table hinge is configurable between the compressed configuration and an expanded configuration, the upper-front and lower-front elongated members being spaced apart and the upper-rear and lower-rear elongated members being spaced apart when the table is in the expanded configuration.

3. The convertible table of claim 2, the table top unit further comprising:

a latch connected to the bottom of the table top unit, the latch contacting the upper-front elongated member when the table hinge is configured in the expanded position.

4. The convertible table of claim 3, the latch comprising:

an outer pin;

a first pivoting member having first and second opposing ends, the first pivoting member pivotable about the outer pin;

an inner pin; and a second pivoting member having first and second opposing ends, the second pivoting member pivotable about the inner pin.

5. The convertible table of claim 4, wherein the two second opposing ends of the first and second opposing members contact one another.

6. The convertible table of claim 5, wherein the first opposing end of the first pivoting member, when moved by a force applied by a user thereto, causes the second opposing end of the first pivoting member to apply force to the second opposing end of the second pivoting member, the second pivoting member then rotating about the inner pin to move the first opposing end of the second pivoting member in the same general direction as the force applied by the user.

7. The convertible table of claim 6, wherein pivoting of the first opposing end of the second pivoting member in the same general direction as the force applied by the user causes the latch to release the table hinge from the expanded configuration, thereby allowing the table hinge to move into the compressed configuration.

8. The convertible table of claim 4, further including:

a strut having a stationary end and a sliding end, the stationary end being connected to the table top unit; and a strut bracket connected to the upper-front elongated member and to the sliding end of the strut.

9. The convertible table of claim 8, wherein the strut bracket contacts the first opposing end of the second pivoting member when the table hinge is in the expanded position.

10. The convertible table of claim 9, wherein the strut bracket contacts the first opposing end of the second pivoting member near where the strut bracket contacts the upper-front elongated member.

11. The convertible table of claim 8, wherein the strut bracket does not contact the first opposing end of the second pivoting member when the table hinge is in the compressed position.

12. The convertible table of claim 1, the table top unit further comprising:

a first table leaf; and a plurality of first butt hinges pivotally connecting the first table leaf to the table top unit.

13. The convertible table of claim 12, the table top unit further comprising:

a second table leaf; and a plurality of second butt hinges pivotally connecting the second table leaf to the table top unit.

14. The convertible table of claim 13, the table top unit further comprising:

a first drop leaf support pivotally connecting the first table leaf to the table top unit; and a second drop leaf support pivotally connecting the second table leaf to the table top unit.

15. The convertible table of claim 14, the first and second drop leaf supports supporting the first and second table leafs in first positions where the two table leafs extend perpendicularly downward from the top planar surface and second positions where the two table leafs extend parallel to the top planar surface.

16. The convertible table of claim 1, the four top hinge brackets comprising:

(a) two upper-front hinge brackets; and (b) two upper-rear hinge brackets; and the four bottom hinge brackets comprising:

(a) two lower-front hinge brackets; and (b) two lower-rear hinge brackets.

17. The convertible table of claim 16, the two upper-front dowels rotatably and slidably fitting into the two upper-front hinge brackets;

the two lower-front dowels rotatably and slidably fitting into the two lower-front hinge brackets;

the two upper-rear dowels rotatably fitting into the two upper-rear hinge brackets; and the two lower-rear dowels rotatably fitting into the two lower-rear hinge brackets.

18. A convertible table, comprising:

(a) a table bottom unit;

(b) lower hinge bracket means connected to the table bottom unit;

(c) a table top unit;

(d) upper hinge bracket means connected to the bottom of the table top unit;

(c) a table hinge positioned between the table bottom unit and the table top unit, comprising:

(1) an upper-front elongated member fitting into the upper hinge bracket means;

(2) an upper-rear elongated member fitting into the upper hinge bracket means;

(3) a lower-front elongated member fitting into the lower hinge bracket means;

(4) a lower-rear elongated member fitting into the lower hinge bracket means;

(5) a first set of parallel fingers connected between the upper-front elongated member and the lower-rear elongated member;

(6) a second set of parallel fingers connected between the lower-front elongated member and the upper-rear elongated member;

(7) a pin running through a center point of each of the fingers to allow the fingers to rotate about the pin to bring the upper-front and lower-front elongated members into contact with one another, and to bring the upper-rear and lower-rear elongated members into contact with one another to thereby bring the table hinge into a compressed configuration;

(f) a latch connected to the bottom of the table top unit, the latch contacting the upper-front elongated member when the table hinge is not configured in the compressed configuration;

(g) a strut having a stationary end and a sliding end, the stationary end being connected to the bottom of the table top unit; and (h) a strut bracket connected to the upper-front elongated member and to the sliding end of the strut.

19. The convertible table of claim 18, wherein the upper and lower hinge bracket means are nylon.

* * * * *